United States Patent [19]

Pusic

[11] Patent Number: 5,027,757

[45] Date of Patent: Jul. 2, 1991

[54] TWO-STROKE CYCLE ENGINE CYLINDER CONSTRUCTION

[76] Inventor: Pavo Pusic, Moluntska 6, Dubrovnik, Yugoslavia, 50000

[21] Appl. No.: 377,475

[22] Filed: Jul. 10, 1989

[51] Int. Cl.[5] ..... F02B 75/02

[52] U.S. Cl. ..... 123/65 A; 123/65 UB; 123/74 AE; 123/73 BA

[58] Field of Search ..... 123/65 R, 65 A, 74 AE, 123/65 VB, 65 VC, 65 VD, 65 P, 73 B, 73 BA, 73 PP, 73 AB, 74 B

[56] References Cited

U.S. PATENT DOCUMENTS

| | | | |
|---|---|---|---|
| Re. 27,367 | 5/1972 | Von Seggern et al. | 123/73 BA |
| 744,881 | 11/1903 | Sohnlein | 123/65 A |
| 855,115 | 5/1907 | Metzler | 123/73 BA |
| 1,255,150 | 2/1918 | Franklin | 123/73 B |
| 1,386,965 | 8/1921 | Simpson | 123/74 B |
| 1,531,397 | 3/1925 | Ringwald et al. | 123/65 A |
| 1,780,138 | 10/1930 | Pielstick | 123/65 A |
| 1,785,909 | 12/1930 | McKinney | 123/74 AE |
| 2,285,671 | 6/1942 | Mallory | 123/65 VB |
| 2,610,785 | 9/1952 | Carlson | 123/65 R |
| 3,168,890 | 2/1965 | Eilert | 123/73 AB |
| 3,270,722 | 9/1966 | Bernard | 123/257 |
| 3,916,851 | 11/1975 | Otani | 123/257 |
| 4,016,839 | 4/1977 | Morton | 123/65 R |
| 4,386,587 | 6/1983 | Simko | 123/65 R |
| 4,445,467 | 5/1984 | Westerman et al. | 123/65 R |
| 4,660,513 | 4/1987 | Figliuzzi | 123/65 A |

FOREIGN PATENT DOCUMENTS

| | | | |
|---|---|---|---|
| 721473 | 3/1932 | France | 123/74 AE |
| 0145814 | 11/1979 | Japan | 123/73 AB |
| 2115485 | 9/1983 | United Kingdom | 123/73 B |
| 80/02309 | 10/1980 | World Int. Prop. O. | 123/197 AC |

*Primary Examiner*—David A. Okonsky

*Attorney, Agent, or Firm*—Marks Murase & White

[57] ABSTRACT

A cylinder for an internal-combustion two-stroke engine, having multiple intake ports, multiple intake valve ports and multiple exhaust ports. The cylinder enables a two-stroke engine to run on gasoline without premixing it with lubricating oil and, due to its optimal volumetric efficiency and good separation of air-fuel mixture and exhaust gases, provides the possibility to satisfy requirements for high fuel efficiency, high power output and low emissions released into the atmosphere. An engine using this cylinder construction will be lightweight, will not require valve trains and camshaft and can be manufactured with any number of cylinders. Utilizing a slightly different process and slightly different configuration, the present invention will also enable a two-stroke engine to run on diesel fuel and produce significant benefits in comparison to existing two-stroke diesel engines.

20 Claims, 3 Drawing Sheets

TWO-STROKE CYCLE ENGINE CYLINDER CONSTRUCTION

BACKGROUND OF THE INVENTION

Two-stroke cycle internal-combustion engines have been used for decades as power plants in automobiles, trucks, motor boats, motorcycles, lawn mowers, snow removers, power saws and other similar equipment. Since they are usually air-cooled and do not require a camshaft and valve trains, they are relatively lightweight, simple in construction and easy to service. Therefore, two-stroke cycle engines are desirable to run equipment that must be handled and moved around. However, because of problems, such as too much exhaust pollution, poor power output at low speeds and lower fuel efficiency in comparison with four-stroke engines, two-stroke cycle engines generally have not been used in automobiles during the last two decades.

In order to eliminate the disadvantages associated with two-stroke cycle engines and enable their use in automobiles, significant improvements have recently been made in the development of the two-stroke engine. Two of the most important improvements in the prior art are Ralph Sarich's engine developed by Orbital Walbro in Australia and the stepped piston engine developed by Bernard Hooper Engineering (BHE) in the United Kingdom. Both of these engines seem to provide the possibility of eliminating the disadvantages of the classical two-stroke engine and enabling significant savings with regard to the engine's manufacturing costs, size and weight. However, Orbital's engine requires sophisticated additional equipment in order to satisfy the requirements and BHE's engine requires at least two cylinders in order to function and can be manufactured with an even number of cylinders. It is not likely that these engines will be used as power plants for low cost simple equipment, either because of their manufacturing costs or inability to function as a simple single-cylinder engine. Indeed, the object of these inventions was to provide a two-stroke engine for use in automobiles and boats.

SUMMARY OF THE INVENTION

The primary object of the present invention is to provide an internal-combustion two-stroke engine cylinder construction which will have a simple configuration and satisfy the requirements for power output, fuel efficiency and low exhaust pollution. The cylinder construction will enable manufacturing of two-stroke engines which can have any desired number of cylinders and will not require any sophisticated additional equipment. The present invention will also enable significant savings in terms of manufacturing costs, size, weight, fuel efficiency and power output. Therefore, the cylinder construction of the present invention will have all of the desirable characteristics both for small engines used to run equipment that must be handled and moved around and for engines that are used as power plants in automobiles, trucks, buses, heavy machinery, motorcycles, boats, etc. An engine using the cylinder construction of the present invention can be machined to run on gasoline, diesel or some other fuel used in internal-combustion engines and will not require lubricating oil to be premixed with fuel. According to the process of the present invention, lubricating oil is used for engine lubrication in the same manner as with four-stroke engines in the prior art.

According to the process of the present invention, during the compression-intake stroke, the air-fuel mixture inside the cylinder will be compressed by the piston inbetween the piston head and cylinder head and, simultaneously, fresh air will be drawn inside the cylinder inbetween the piston's bottom and the bottom cylinder wall which seals the lower edges of the cylinder walls. Because the cylinder construction is used in conjunction with the present inventor's hydraulic connecting rod construction (discussed below) the cylinder can be sealed at its bottom by the bottom cylinder wall; this prevents the air drawn into the cylinder from escaping into the engine's crankcase when compressed by the piston. Theoretically, the amount of fresh air drawn inside the cylinder and compressed by the piston's downward motion equals the amount of air-fuel mixture which will provide 100% volumetric efficiency. However, in practice this amount of air-fuel mixture will never completely fill-up the entire cylinder area above the piston at its bottom dead center (BDC) and this is not intended for the process of the present invention. The process requires an amount of air-fuel mixture which will fill up the cylinder area above the upper edges of the exhausts ports which is considered 100% volumetric efficiency and will happen in practice. This will prevent the air-fuel mixture from escaping through the exhaust ports and being wasted.

As combustion occurs, the combustion pressure pushes the piston downward and, simultaneously, the piston compresses air located between its bottom and the bottom cylinder wall and pushes the air inside the transfer manifolds wherein fuel is injected and the air-fuel mixture formed. As the piston nears its BDC, exhaust gasses stream out of the cylinder through the exhaust ports now cleared by the piston and at the same time fresh air-fuel mixture is delivered through the intake valves. Accordingly, when the piston covers the exhaust ports on its way up toward its top dead center (TDC) all the exhaust gasses are drawn out of the cylinder and the cylinder's area above the piston is filled with fresh air-fuel mixture. Consequently, the air-fuel mixture (which is to be compressed) is free of the exhaust gas and, therefore, will burn properly when ignited resulting in optimal combustion force and relatively clean exhaust gas. In addition, due to the absence of exhaust gas in air-fuel mixture, the engine will not have cold start difficulties of the type which occur in classical two-stroke engines.

It is to be understood that the process of the present invention is made possible by the process of the present inventor's previous invention which was disclosed in U.S. Pat. application Ser. No. 07/333,685 entitled Hydraulic Connecting Rod and filed on Apr. 5, 1989. As explained later in the description of the preferred embodiment, the present invention can have two slightly different configurations and processes in order to provide both gasoline and diesel two-stroke engines. The present invention will have all advantages of a classical two-stroke engine, such as low weight, low volume, low manufacturing costs and a simple configuration. Further, the present invention will eliminate all the disadvantages of classical two-stroke engines. Moreover, the present invention will have higher power output per weight and better fuel efficiency than existing four-stroke engines without producing more negative effects regarding emission of pollutants and cold start troubles. It is also to be understood that the present invention can be applied either in conjunction with carburetor or fuel injection systems and either with or without a turbocharging system.

All features and advantages of the present invention will become apparent from the following brief description of the drawings and description of the preferred embodiment.

DESCRIPTION OF THE PREFERRED EMBODIMENT

Figure 1:
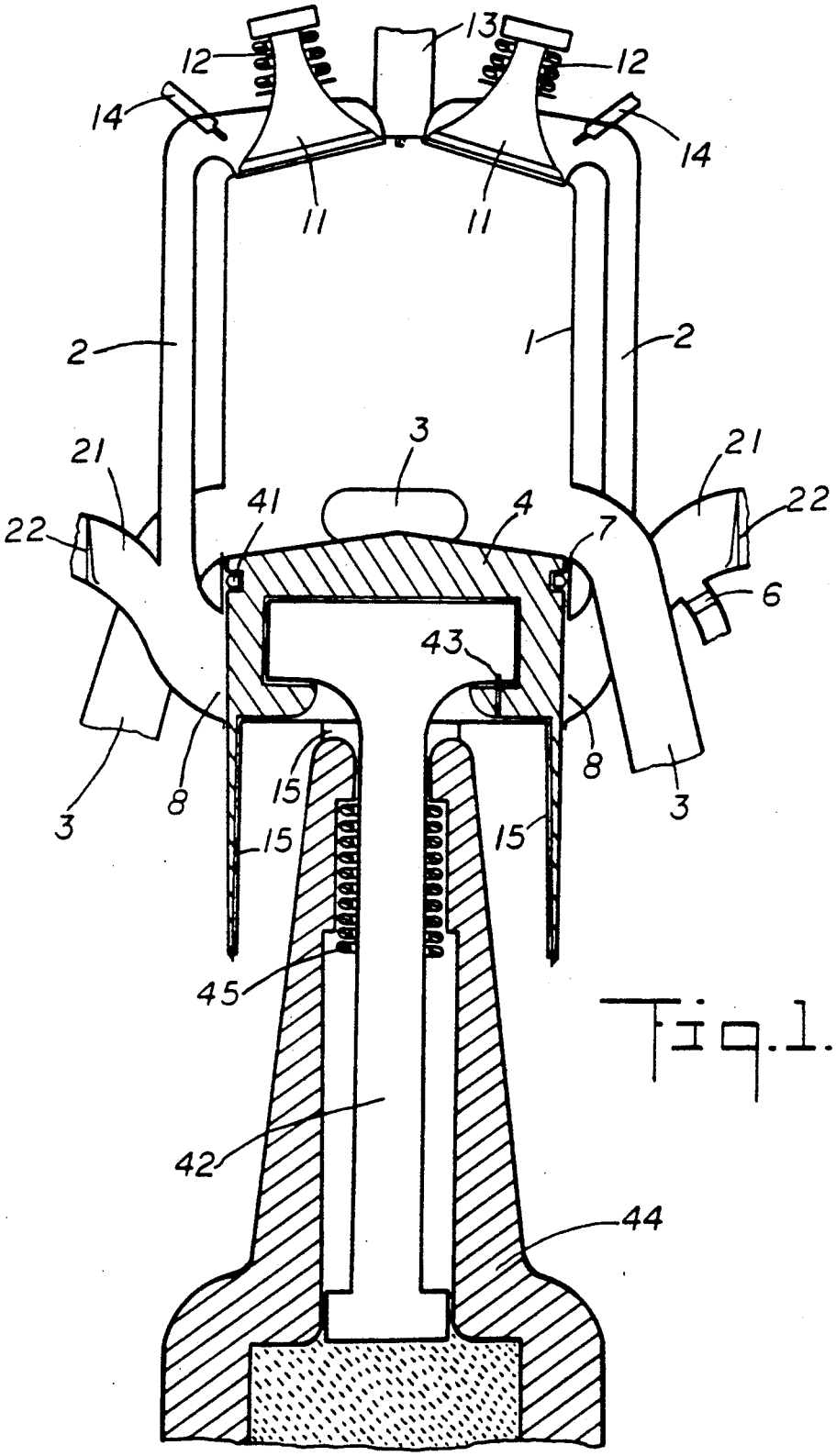
FIG. 1 is a cutaway view showing the cylinder head, cylinder bore, intake and exhaust ports and manifolds and upper part of a hydraulic connecting rod as proposed for a gasoline two-stroke engine.
Figure 2:
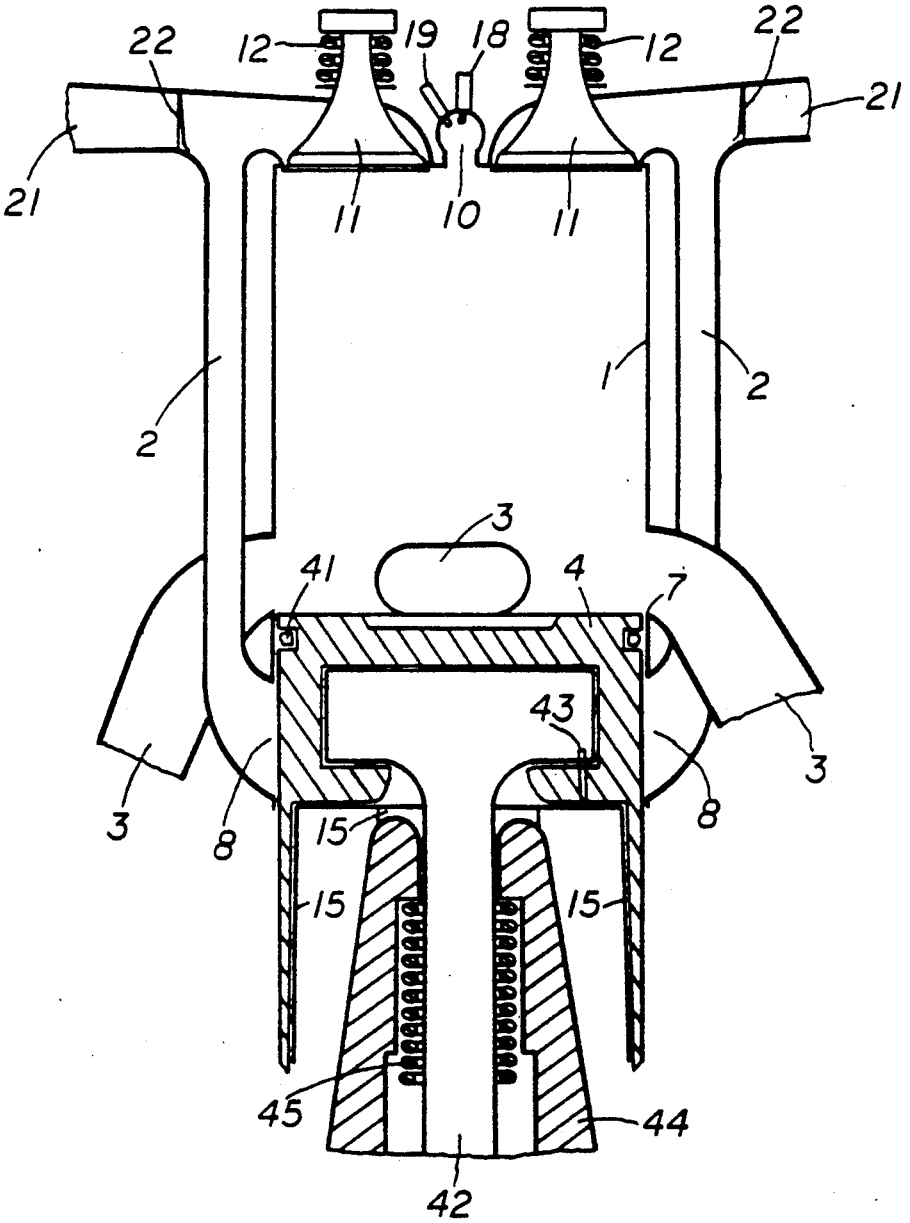
FIG. 2 is a cutaway view showing the cylinder head, cylinder bore, intake and exhaust ports and manifolds and upper part of a hydraulic connecting rod as proposed for a diesel two-stroke engine.
Figure 5:
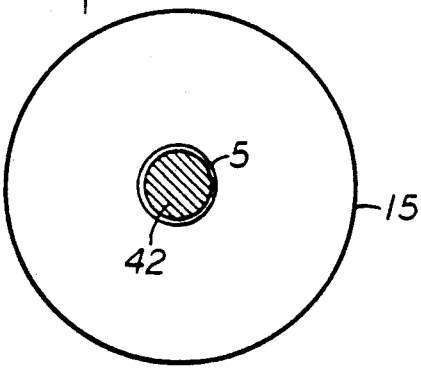
FIG. 5 is a top cutaway view showing a bottom cylinder wall.
Figure 7:
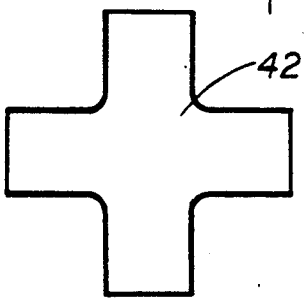
FIG. 7 is a top cutaway view showing the upper part of the smaller hydraulic piston which replaces a classical piston pin.
Figure 8:
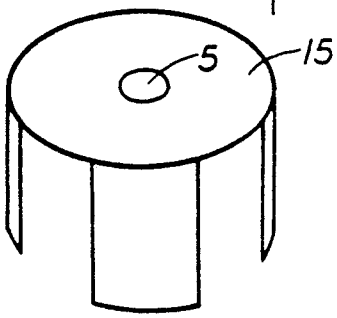
FIG. 8 is a perspective view of a cylinder bottom wall.

Referring to FIG. 1, there is shown a two-stroke engine cylinder construction comprising intake valves 11, transfer manifolds 2, intake manifolds 21, exhaust ports 3, engine piston 4, smaller hydraulic cylinder housing 44 and small hydraulic piston 42. It is assumed that the present invention is machined in an engine, wherein the hydraulic connecting rod is applied which causes the smaller hydraulic piston 42 and the engine piston 4 to perform their reciprocating motion without any divergence with respect to their vertical motion line. Since the smaller hydraulic piston 42 performs a completely straight vertical motion, the bottom of the engine cylinder bore 1 is sealed by the bottom cylinder wall 15 shown in FIGS. 1, 2, 4, 5 and 8. The bottom cylinder wall 15 has an opening in its middle, as shown in FIGS. 5 and 7, through which the smaller hydraulic piston 42 performs its reciprocating motion. The smaller hydraulic piston 42 fits the opening 5 in a manner which prevents "blow out" of air between the cylinder 1 and engine crankcase under any engine operating conditions. The bottom cylinder wall 15 is machined in the shape, shown in FIGS. 1, 2, 4, 5 and 7, with four prolonged parts which fit the piston slipper skirt's prolonged parts 46 under the four exhaust ports 3, as shown in FIGS. 1 and 2. The bottom cylinder wall 15 can be machined without said four prolonged parts, i.e., only with holes for receiving the piston skirt's prolonged parts 46 if proven more effective for the purpose of the present invention. The prolonged parts of the piston skirt 46 cover the exhaust ports 3 during the piston reciprocating motion in order to prevent exhaust gasses from returning inside the cylinder 1 when vacuum is created (by upward movement of the piston) and to prevent "blow-out" of compressed air during the piston's 4 downward motion. The prolonged parts of the piston skirt 46 slide up and down over the prolonged parts of the cylinder bottom wall 15 which are lubricated by the rotating motion of the crankshaft which sprays some of lubricating oil on them when the piston 4 leaves BDC. Also, the crankshaft sprays some lubricating oil on the outer side of the prolonged parts of the piston's skirt 46 which during the piston's upward motion carries lubricating oil inside the cylinder 1 for purpose of lubricating the cylinder walls 1. Since the piston 4 does not produce any side thrust on the cylinder walls 1 (because it moves straight up and down) no extensive lubrication is needed and the small amount of oil mist will satisfy lubrication requirements for the cylinder 1 walls. It is assumed that the piston skirt's and the exhaust port's configurations are machined with oil directing means, such as little notches along the piston skirt and small humps 7 on the exhaust ports 3 in order to provide satisfactory lubrication and prevent the oil from entering said ports 3 (either when carried up or scraped back) and burning either in the cylinder 1 or in the exhaust manifolds. It is also assumed that the lubrication can be provided by using an oil pump, if proven necessary and more appropriate for the process of the invention.

Figure 3:
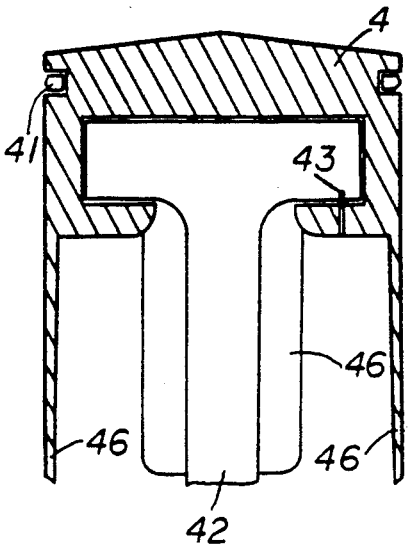
FIG. 3 is a cutaway view showing the engine piston as proposed for a gasoline two-stroke engine.
Figure 4:
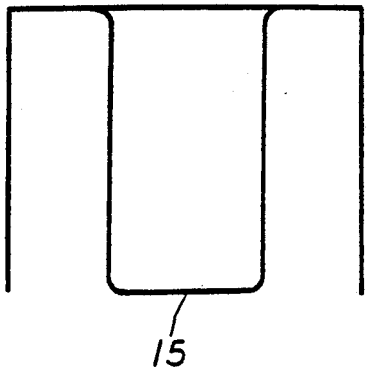
FIG. 4 is a cutaway view showing a bottom cylinder wall.

Since the engine piston 4 slides up and down inside the cylinder bore without any side thrust and does not unevenly press against the cylinder walls 1, it can be machined to fit the cylinder walls 1 accurately enough to have minimum clearance and prevent "blow-by" of the air-fuel mixture and burned gasses. Therefore, only one piston ring 41 is necessary and it should be machined with a joint which will prevent it from expanding too much when passing the exhaust ports 3. In order to decrease the inertia load of the piston 4 and, consequently, make it possible for the spring 45 to absorb all of the inertia load of the piston 4 and the smaller hydraulic piston 42, one of the lightweight types of piston has to be used. The piston 4, as shown in FIGS. 1, 2 and 3, is much shorter than pistons in the prior art. The manufacturing method and material used for the piston 4, piston ring 41 and the cylinder walls 1 must provide a good seal between these components under any engine operating conditions. Elimination of friction between the piston 4 and the cylinder walls 1 allows use of lightweight materials, such as aluminum, for both the piston's 4 and the walls' construction but any other satisfactory combination can be applied for the purpose of obtaining a good seal and satisfactory durability. Regardless of the fact that, for the purpose of the present invention, the piston pin can be machined as in the prior art, it is the proposal of the present invention to use a four-armed piston pin in a cross shape which is an integral part of the smaller hydraulic piston 42, as shown in FIGS. 1, 2, 3 and 7. Since, unlike in the prior art, no rotating motion of the connecting rod is performed on the piston pin 42, it can be machined in said cross shape, as shown in FIG. 7, in order to provide sufficient strength when machined in a smaller volume. Consequently, pin holes are not required inside the piston's 4 skirt section. Instead four piston bosses are provided and the four-armed upper part of the smaller hydraulic piston 42 is inserted into the bosses and locked by the bolt lock 43, as shown in FIGS. 1, 2 and 3. By virtue of this construction, the ring groove(s) can be machined anywhere on the piston skirt which is significantly shorter than a conventional piston skirt as shown in FIGS. 1, 2 and 3. Since transmission of force is performed over the four piston bosses, their volume and the volume of each pin's arm can be smaller than that of the bosses and pins of the prior art without decreasing the total strength of said bosses and pins.

As shown in FIGS. 1 and 3, for the process of a gasoline two-stroke engine, the piston's 4 head is slanted from its center towards its outer peripheral edge in order to provide better flow of exhaust gasses toward the exhaust ports 3 when the piston 4 approaches and leaves its BDC. For the process of a diesel two-stroke engine the piston's 4 head is shaped as shown in FIG. 2.

As shown in FIGS. 1 and 2, four exhaust ports 3 are located symmetrically inside the cylinder walls 1 above the line of the piston 4 head at the BDC. The ports 3 are located symmetrically in order to enable "flow-out" of all exhaust gasses. However, if a more suitable shape is found for use of the present invention in a multiple cylinder engine, the piston 4 head shape and the exhaust 3 and intake ports 8 can be shaped and located according to some different principle. As shown in FIGS. 1 and 2, four intake ports 8 are located symmetrically in the cylinder walls 1 above the line of the bottom cylinder wall 15. For the process of the present invention, either both the intake manifolds 21 and the transfer manifolds 2 are connected to the intake ports 8 as shown in FIG. 1, or only the transfer manifolds are connected to the intake ports 8 as shown in FIG. 2. The intake manifolds are provided with reed valves 22 in order to prevent "blow out" of air drawn inside the manifolds 21 and 2 and the cylinder 1 when compression of said air occurs.

Figure 6:
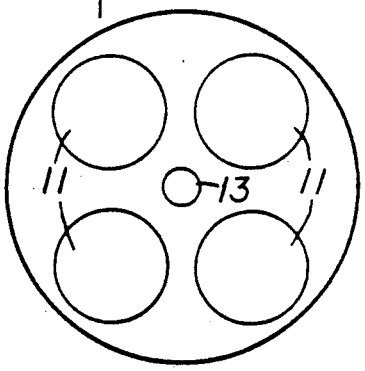
FIG. 6 is a bottom view showing a cylinder head for a gasoline two-stroke engine.

As shown in FIGS. 1 and 6, the cylinder head 17 for the gasoline engine has a hemispheric shape which provides optimal "surface to volume ratio" (S/V) of the combustion chamber in order to produce a lesser amount of unburned HC in the exhaust gas. The cylinder head configuration also enables the spark plug 13 to be located in the middle, as shown in FIG. 6; this enables normal combustion, wherein the after ignition flame has a shorter path to travel and spreads evenly and uniformly away from the spark plug electrodes.

For the process of a diesel engine, the cylinder head has a flat surface, as shown in FIG. 2, wherein the precombustion chamber 10 is machined in the middle of the head. The precombustion chamber 10 is supplied with the fuel injector 18 and the glow plug 19.

As shown in FIGS. 1, 2 and 6, four intake valves 11 are provided inside the cylinder head 17 on the inner edges of the transfer manifolds 2. The intake valves 11 have the same shape as intake valves in the prior art with the difference that their stems are much shorter and that they are not operated by camshafts. As shown in FIGS. 1, 2 and 6, the intake valves 11 are inserted inside the cylinder head 17 and operated by springs 12 which are mounted on their stems. According to the process of the present invention, the intake valves 11 are operated both by changes in pressure inside the cylinder 1 and inside the transfer manifold and by said springs 11. The springs 12 are supposed to be strong enough only to hold valves 11 in the closed position when pressure inside the cylinder 1 equals pressure inside the transfer manifold 2. Accordingly, as soon as the pressure inside the transfer manifold 2 increases above the pressure inside the cylinder 1, the valves 11 open, and as soon as the two pressures equal each other, the valves 11 close. The valves 11 remain closed as long as the pressure inside the cylinder 1 is higher than the pressure inside the transfer manifold 2.

For the purpose of explanation of the process of the present invention, it is assumed that fuel injectors 14 are applied for the process of the invention but it is to be understood that the invention can function with a carburetor-type fuel supplying system.

The following description of the process of the present invention refers to the operation of gasoline two-stroke engines and will start with the assumption that the piston 4 is at its TDC and that the cylinder area under the piston 4 is filled with air at atmospheric pressure. Assuming that at this point the piston 4 is pulled down by the engine starting means, the piston 4 presses the air located between its bottom and the bottom cylinder wall 15. The air is pushed by the piston 4 and streams out through the intake ports 8 into the transfer manifolds 2. This causes pressure inside the transfer manifolds 2 to increase and the air streams up toward the intake valves 11. The reed valves 22 inside the intake manifolds 21 are closed because the pressure inside the inner part of the manifolds 21 exceeds the pressure inside their outer parts, i.e., the pressure differential is such that the reed valves are pushed to the closed position. At this point fuel is injected inside the transfer manifolds 2 and it mixes with air which flows through the intake valves 11 inside the cylinder 1. According to the process of the present invention, the intake valves 11 open as soon as pressure inside the transfer manifolds 2 rise above the pressure inside the cylinder. As the piston 4 slides down toward its BDC, it pushes out the entire amount of air from the bottom of the cylinder 1 and that amount of air, now mixed with fuel fills up the upper part of the cylinder 1. When the piston reaches its BDC, it turns upward and the air-fuel mixture continues to stream into the cylinder 1. When the piston 4 covers the exhaust ports 3 on its way up toward its TDC, the pressure inside the cylinder 1 equals the pressure inside the transfer manifolds 2 and the intake valves 11 return to a closed position. The air-fuel mixture is now trapped between the piston head 4 and the cylinder head 17 and the piston 4 compresses the air-fuel mixture while sliding up towards its TDC. Simultaneously, the vacuum created under the piston 4 draws in air from the intake manifold 21 which causes the reed valves 22 to open and let fresh air flow inside the intake manifolds 21 and the cylinder 1. When the piston 4 almost reaches its TDC, the air-fuel mixture above the piston 4 is compressed and ignited and the cylinder area below the piston 4 is filled up with fresh air. The combustion pressure now pushes the piston 4 down such that the piston exerts pressure on the accumulated fresh air. This causes the pressure inside the transfer manifolds 2 to increase and the reed valves 22 to close. The force exerted by the combustion pressure pushes the piston 4 down and, as the combustion pressure drops, the pressure of the air increases. When the pressure inside the transfer manifolds 2 increases above the combustion pressure inside the cylinder 1, which is supposed to happen just before the piston starts to uncover the exhaust ports 3, the intake valves 11 open and the air-fuel mixture starts to stream into the cylinder 1. Since the intake ports and valves 11 are shaped to provide a good swirl action, the air-fuel mixture presses evenly and uniformly the burned exhaust gasses which begin to stream out as the piston 4 starts to uncover the exhaust ports. The exhaust gasses stream out both because their own pressure exceeds the pressure inside the exhaust manifolds 3 and because they are pushed by the air-fuel mixture. Accordingly, during the portion of the piston 4 path from the upper edge of the exhaust ports 3 to its BDC and back to the upper edge of the exhaust ports 3 all exhaust gasses are drawn out of the cylinder 1 and the area above the piston 4 is filled-up with the air-fuel mixture.

The above mentioned process is repeated and the engine action is continued as described above for compression and intake process.

It is assumed that the entire cylinder configuration is shaped in a manner which will enable all exhaust gasses to be drawn out of the cylinder bore exactly at the point when the piston 4 covers the exhaust ports 3 and which will enable the air-fuel mixture to fill-up the cylinder area above the exhaust ports 3.

Since some of the air compressed under the piston 4 will escape into the crankcase, either through the openings on the outer edges of the bottom cylinder wall 15 or through its middle opening 5, it will create some pressure inside the sealed crankcase. Therefore, in accordance with the present invention a positive crankcase ventilation breather opening 6 is connected on one of the intake manifolds 21, as shown in FIG. 1, in order to return crankcase vapors into the cylinder and burn them. Only a simple opening 6 and simple valve are required for this purpose.

According to above description, it is obvious that the present invention will enable excellent burning of the entire air-fuel mixture and, therefore, provide a powerful, fuel efficient and clean two-stroke engine. Satisfactory separation of exhaust gasses and air-fuel mixture can be achieved and the troubles experienced with the classical two-stroke engine can be eliminated. Since it is obvious that the present invention will enable a gasoline two-stroke engine to be more simple, more cost effective and have higher power output than Orbital's two-stroke engine, the real advantages become obvious from the following data. The developers of the Orbital engine claim a $200 savings in comparison with V6, 194-hp engines and a 30% better power output than comparable four-stroke engines due to no loss of air-fuel mixture during valve overlap and lower internal friction. Furthermore, the costs of capital investment for a three-cylinder Orbital's OCP engine will be at least 40% lower than the costs for a comparable four-stroke engine plant.

The following description of the process of the present invention for the diesel two-stroke engine slightly differs from the above description regarding the fuel injection and ignition procedures. As shown in FIG. 2, the cylinder configuration for a diesel engine does not require fuel injectors inside the transfer manifolds and has a different cylinder head shape, wherein the precombustion chamber 10 is machined in the middle of the cylinder head. The precombustion chamber 10 is supplied with a fuel injector 18 and a glow plug 19. The cylinder head 17 and the piston 4 head are shaped to provide a much smaller combustion chamber in order to obtain the much higher compression ratio required for the process of a diesel engine.

Regarding the processes of the invention, gasoline and diesel, the only difference between them is the method of fuel injection and ignition. Thus, for the process of a diesel engine, fuel is not mixed with air entering the cylinder. Instead, the fuel is injected into the cylinder at the end of the compression stroke as in the process known in the prior art for diesel engines. The operation of the glow plug 19 also refers to the process in the prior art.

Since the present invention has to be used in conjunction with a hydraulic connecting rod, the diesel engine vibrations will be significantly decreased resulting in a relatively quiet engine which will widen its use in passenger cars. As stated before for the gasoline engine, the diesel engine will enable better burning of fuel and satisfactory separation of air and exhaust gasses and, therefore, will eliminate recognized disadvantages of a classical two-stroke diesel engine. It will also be lightweight, simple in construction, more fuel efficient, have higher power output and release less pollutants into the atmosphere.

It is to be understood that the present invention has been described in relation to particular embodiments, herein chosen for the purpose of illustration and that the claims are intended to cover all changes and modifications, apparent to those skilled in the art which do not constitute departure from the scope and spirit of the invention.

What is claimed is:

1. A cylinder construction for a two-stroke cycle internal combustion engine, the cylinder construction comprising: a housing; a cylinder bore formed in the housing, the cylinder bore having cylindrical side walls and first and second ends and a cylinder head at the first end of the cylinder; and a bottom wall portion connected to the cylinder bore at the second end of the cylinder bore so as to seal said second end, the bottom wall portion including a centrally disposed opening formed therein; a plurality of valve ports formed in the cylinder head; a piston having cylindrical side walls and two ends, a head portion at one end, the piston being slidably received within the cylinder bore for substantially rectilinear movement between a top dead center position wherein the piston head is proximate the cylinder head and a bottom dead center position wherein the end of the piston opposite the piston head is adjacent the bottom wall at the second end of the cylinder bore; a connecting rod connected at one end thereof to the piston and extending through the centrally disposed opening formed in the bottom wall portion; at least two intake ports formed in the cylindrical side wall of the cylinder bore proximate the second end of the cylinder bore at a location below the piston head when the piston is located in its bottom dead center position; and at least two transfer manifolds formed in the housing, each transfer manifold providing fluid communication between one of the intake ports and one of the valve ports formed in the cylinder head; at least two fuel supply devices, each fuel supply device having at least a portion thereof located in one of the transfer manifolds for supplying fuel to the respective transfer manifold; intake manifolds formed in the housing and each extending from the exterior of the housing into a respective one of the transfer manifolds; and a one-way valve located in each said intake manifold so as to allow passage of fluid from the exterior of the housing into the transfer manifold but to prevent fluid flow from the transfer manifold to the exterior of the housing.

2. The cylinder construction of claim 1 comprising four intake ports, four transfer manifolds and four intake valves, each transfer manifold providing fluid communication between one of the four intake ports and one of the four intake valves.

3. The cylinder construction of claim 1, further comprising a plurality of spring mounted valves having head portions which are adapted to close the valve inlets formed in the cylinder head, and wherein the valves are pressure responsive such that the valve closes the inlets when the pressure inside the cylinder bore portion adjacent to the valve inlets exceeds the pressure inside the inlets and the valves are biased away from the openings so as to allow fluid communication through the valve inlets into the cylinder bore when the pressure inside the valve inlets exceeds the pressure inside the cylinder bore portion adjacent to the valve inlets.

4. The cylinder construction of claim 1, wherein the cylinder head is hemispherical.

5. The cylinder construction of claim 1, wherein the connecting rod includes a portion mounted for substantially rectilinear movement, and the rectilinear moving connecting rod portion includes a plurality of arms formed at the end thereof which is connected to the piston; and wherein the piston includes a plurality of bosses for receiving said arms such that the rectilinear moving portion of the connecting rod is non-rotatably connected to the piston.

6. The cylinder construction of claim 1, wherein the at least one intake port is the closest port to the second end of the cylinder.

7. The cylinder construction of claim 1, wherein the connecting rod is a hydraulic connecting rod.

8. The cylinder construction of claim 1, further comprising a plurality of exhaust ports formed in the cylindrical side walls of the cylinder bore at a location just above the piston head when the piston is located in its bottom dead center position.

9. The cylinder construction of claim 8, wherein the piston further comprises a plurality of piston wall extensions extending from the end of the side wall of the piston opposite the piston head so as to cover said exhaust ports when said piston head is proximate its top dead center position.

10. A cylinder construction for a two-stroke cycle internal combustion engine, the cylinder construction comprising: a housing; a cylinder bore formed in the housing, the cylinder bore having cylindrical side walls and first and second ends and a cylinder head at the first end of the cylinder and a bottom wall portion connected to the cylinder bore at the second end of the cylinder bore so as to seal said second end, the bottom wall portion including a centrally disposed opening formed therein; a plurality of valve ports formed in the cylinder head; a piston having a head portion and a side wall, the piston being slidably received within the cylinder bore for substantially rectilinear movement between a top dead center position wherein the piston head is proximate the cylinder head and a bottom dead center position wherein the end of the piston opposite the piston head is adjacent the bottom wall at the second end of the cylinder bore; a connecting rod connected at one end thereof to the piston and extending through the centrally disposed opening formed in the bottom wall portion; at least two exhaust ports formed in the cylindrical side wall of the cylinder bore, at least two intake ports formed in the cylindrical side wall of the cylinder bore proximate the second end of the cylinder bore, the intake ports being located closer to the second end of the cylinder than any other port in the cylindrical side wall of the cylinder bore; and at least two transfer manifolds formed in the housing, each transfer manifold providing unrestricted fluid communication between on e of the intake ports closest to the second end and one of the valve ports formed in the cylinder head; and a plurality of piston wall extensions extending from the end of the side wall of the piston opposite the piston head so as to cover said exhaust ports when said piston head is proximate its top dead center position.

11. The cylinder construction of claim 10, further comprising an intake manifold formed in the housing and extending from the exterior of the housing into the transfer manifold; and a one-way valve located in said intake manifold so as to allow passage of fluid from the exterior of the housing into the transfer manifold but to prevent fluid flow from the transfer manifold into the exterior of the housing.

12. The cylinder construction of claim 10, further comprising a plurality of spring mounted valves having head portions which are adapted to close the valve inlets formed in the cylinder head and wherein the valves are pressure responsive such that the valve closes the inlets when the pressure inside the cylinder bore portion adjacent to the valve inlets exceeds the pressure inside the inlets and the valves are biased away from the openings so as to allow fluid communication through the valve inlets into the cylinder bore when the pressure inside the valve inlets exceeds the pressure inside the cylinder bore portion adjacent to the valve inlets.

13. The cylinder construction of claim 10, comprising four intake ports, four transfer manifolds and four intake valves, each transfer manifold providing fluid communication between one of the four intake ports and one of the four intake valves.

14. The cylinder construction of claim 10, further comprising a plurality of exhaust ports formed in the cylindrical side walls of the cylinder bore at a location just above the piston head when the piston is located in its bottom dead center position.

15. The cylinder construction of claim 14, wherein the cylinder head is hemispherical.

16. A cylinder construction for a two-stroke cycle internal combustion engine, the cylinder construction comprising: a housing; a cylinder bore formed in the housing, the cylinder bore having cylindrical side walls and first and second ends and a cylinder head at the first end of the cylinder and a bottom wall portion connected to the cylinder bore at the second end of the cylinder bore so as to seal said second end, the bottom wall portion including a centrally disposed opening formed therein; a plurality of valve ports formed in the cylinder head; a precombustion chamber formed in the cylinder head; a fuel injector extending into the precombustion chamber; a piston having two side walls and two ends, a head portion at one end, the piston being slidably received within the cylinder bore for substantially rectilinear movement between a top dead center position wherein the piston head is proximate the cylinder head and a bottom dead center position wherein the piston head is proximate the second end of the cylinder bore; a connecting rod connected at one end thereof to the piston and extending through the opening formed in the bottom wall portion; and a plurality of intake ports formed in the cylindrical side wall of the cylinder bore proximate the second end of the cylinder bore at a location below the piston head when the piston is located in its bottom dead center position; and a plurality of transfer manifolds formed in the housing, each transfer manifold associated with one of the intake ports and one of the valve ports, the transfer manifold providing fluid communication between said intake port and said valve port; and a plurality of exhaust ports formed in the cylindrical side walls of the cylinder bore at a location just above the piston head when the piston is located in its bottom dead center position.

17. The cylinder construction of claim 16 comprising four intake ports, four transfer manifolds and four intake valves, each transfer manifold providing fluid communication between one of the four intake ports and one of the four intake valves.

18. The cylinder construction of claim 16, further comprising an intake manifold formed in the housing and extending from the exterior of the housing into the transfer manifold; and a one-way valve located in said intake manifold so as to allow passage of fluid from the exterior of the housing into the transfer manifold but to prevent fluid flow from the transfer manifold into the exterior of the housing.

19. The cylinder construction of claim 16, further comprising a plurality of spring mounted valves having head portions which are adapted to close the valve inlets formed in the cylinder head, and wherein the valves are pressure responsive such that the valve closes the inlets when the pressure inside the cylinder bore portion adjacent to the valve inlets exceeds the pressure inside the inlets and the valves are biased away from the openings so as to allow fluid communication through the valve inlets into the cylinder bore when the pressure inside the valve inlets exceeds the pressure inside the cylinder bore portion adjacent to the valve inlets.

20. The cylinder construction of claim 16 wherein the piston further comprises a plurality of piston wall extensions extending from the end of the side wall of the piston opposite the piston head so as to cover said exhaust ports when said piston head is proximate its top dead center position.

* * * * *